United States Patent [19]

Shinn

[11] Patent Number: 4,748,693

[45] Date of Patent: Jun. 7, 1988

[54] GLOVE LINER

[76] Inventor: John V. Shinn, 1330 NW. Harrison Blvd., Corvallis, Oreg. 97330

[21] Appl. No.: 34,984

[22] Filed: Apr. 6, 1987

Related U.S. Application Data

[63] Continuation-in-part of Ser. No. 910,022, Sep. 22, 1986, abandoned.

[51] Int. Cl.[4] ..... A41D 19/00

[52] U.S. Cl. ..... 2/164; 2/161 R; 2/163

[58] Field of Search ..... 2/164, 161 R, 161 A, 2/159, 163, 167, 168

[56] References Cited

U.S. PATENT DOCUMENTS

| | | | |
|---|---|---|---|
| 325,968 | 9/1885 | Rawlings | 2/164 X |
| 482,647 | 9/1892 | Obear | 2/164 X |
| 2,655,662 | 10/1953 | Edler | 2/163 |
| 4,183,100 | 1/1980 | De Marco | 2/164 X |
| 4,197,592 | 4/1980 | Klein | 2/164 X |
| 4,420,843 | 12/1983 | Genzling et al. | 2/164 X |

*Primary Examiner*—Peter Nerbun

*Attorney, Agent, or Firm*—James D. Givnan, Jr.

[57] ABSTRACT

An absorbent liner for wear beneath a rubber glove. A back portion overlies the back of the hand and is secured by closure pieces to the wearer's wrist. Attached to the back portion are tubular members for placement about the inner segments of the fingers without detracting from the sense of touch. The liner may be of an elastic nature. A modified form of the absorbent liner utilizes elastic tubular fabric with finger receiving tubular members having openings therein for momentary hooked engagement with the finger ends during donning of a rubber glove.

4 Claims, 2 Drawing Sheets

GLOVE LINER

BACKGROUND OF THE INVENTION

The present application is a continuation-in-part of an earlier filed, copending application filed by the same inventor on Sept. 22, 1986, under Ser. No., 06/910,022, now abandoned.

The present invention concerns a glove worn as a liner beneath a rubber glove of the type used by physicians and dentists.

The wearing of rubber gloves by those in the medical and dental professions ofttimes results in irritation of the skin. Such irritation apparently is at least partially attributable to bacteria the growth of which is promoted by the temperature and moisture within the impervious glove. In some instances, individuals may have skin sensitive to direct contact with a rubber or plastic glove.

The wearing of rubber gloves is becoming more common in the practice of dentistry.

SUMMARY OF THE PRESENT INVENTION

The present invention is embodied within an absorbent glove liner covering certain portions of the hand while leaving some or all of the fingertips unencumbered.

The present liner covers those portions of the hand which are a source of perspiration to effectively prevent the accumulation of perspiration on skin surfaces. Loss of the sense of touch is prevented by the insert leaving the fingertips free by reason of the fingers being only partially covered by the insert. Tubular members of the insert are arranged to provide convenient insertion and removal of the fingers including the thumb. The insert is preferably of an elastic nature to provide an insert fee of wrinkles.

A main body portion is preferably of tubular construction and formed from absorbent, elastic fabric with the finger receiving members being of a like fabric and preferably with openings therein for temporary, hooked engagement with the end of the finger during glove application.

Important objectives of the present invention include the provision of an insert for gloves of rubber or any synthetic material which insert absorbs perspiration which would otherwise form on the interior of the glove and result in skin irritation; the provision of an insert for gloves of the type used in the medical and dental professions which provides for the absorption of perspiration without diminishing sensitivity in the user's fingers; the provision of an insert which does not complicate donning or removal of rubber gloves; the provision of an insert which utilizes highly elastic, absorbent fabric of tubular construction; the provision of an insert formed in a manner to permit one glove insert configuration for both hands.

DETAILED DESCRIPTION OF THE PREFERRED EMBODIMENTS

Figure 1:
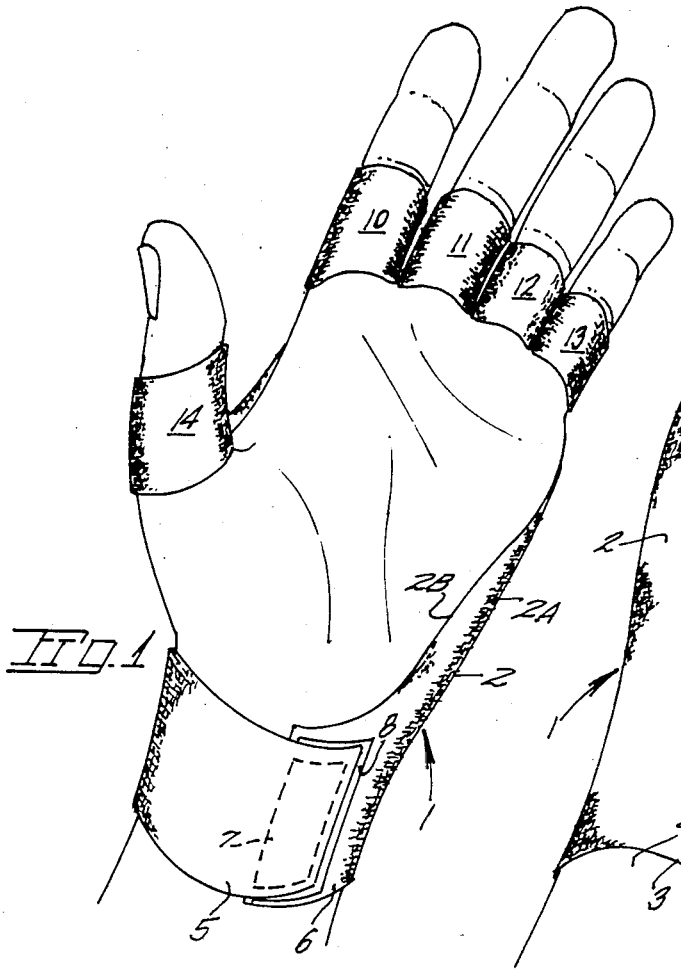
FIG. 1 is a perspective view of the palm side of the left hand, fitted with the present insert with an insert for the right hand being a mirror image.
Figure 2:
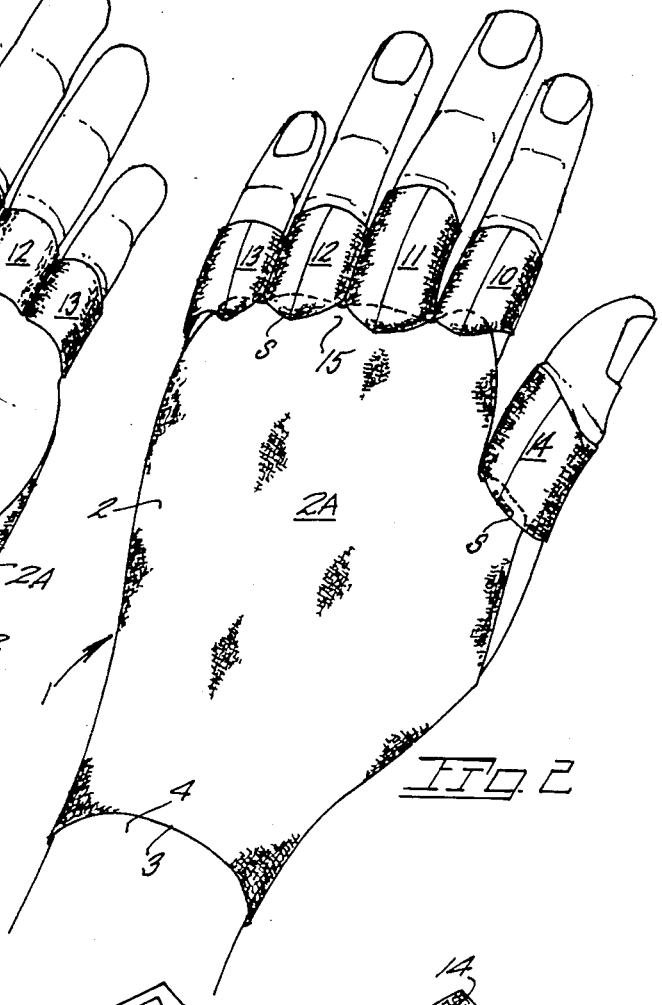
FIG. 2 is a view similar to FIG. 1 but showing the back side of the hand with an insert for the right hand being a mirror image.
Figure 3:
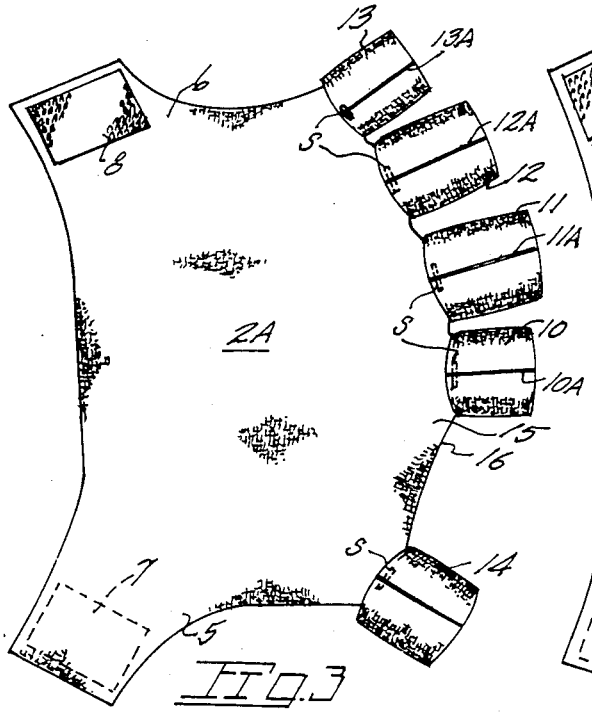
FIG. 3 is a top plan view of the present insert.
Figure 4:
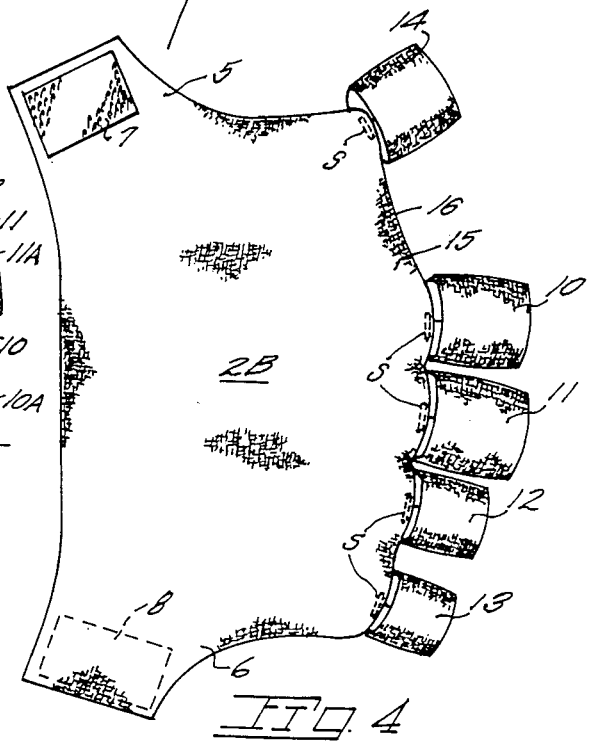
FIG. 4 is a bottom plan view of the present insert.

With continuing attention to the drawings wherein reference numerals indicate parts similarly hereinafter identified, the reference numeral 1 indicates the present insert in place on the left hand of a user. It is understood that an insert for the right hand would be but a mirror image of the illustrated insert.

A main body portion 2 of the insert overlies the back of the user's hand and terminates, in a proximal direction, at 3 adjacent the user's wrist 4. For securement of the insert main body, extensions at 5 and 6 are provided with closure means such as hook and loop patches 7 and 8 enabling securement of the extensions about the wrist. An outer surface of the main body is at 2A while an inner surface is at 2B.

In a distal direction when worn, the main body of the liner terminates along an edge 16 with an outer marginal area at 15. Tubular members 10, 11, 12, 13 and 14 are joined to the outer margin 15 of the main body 2 by means of stitching at S which passes through the inner ends of the tubular members and through the outer margin 15 of the main body portion. Preferably the tubular members are of a length to cover at least the first or proximal row of phalanges of the fingers. Restricting the length of the tubular members avoids loss of the sense of touch and hindering the flexing of the fingers.

One suitable fabric for the insert or liner is the type used in the manufacture of elastic stockings and elastic bandages for the arms and legs and is capable of stretching along at least one axis the objective being the avoidance of wrinkles even when a rubber glove is applied. Accordingly, a few sizes of the present liner will fit most all hand sizes. The tubular members while being shown as having seams at 10A–14A may be knitted in tubular form if desired.

Figure 5:
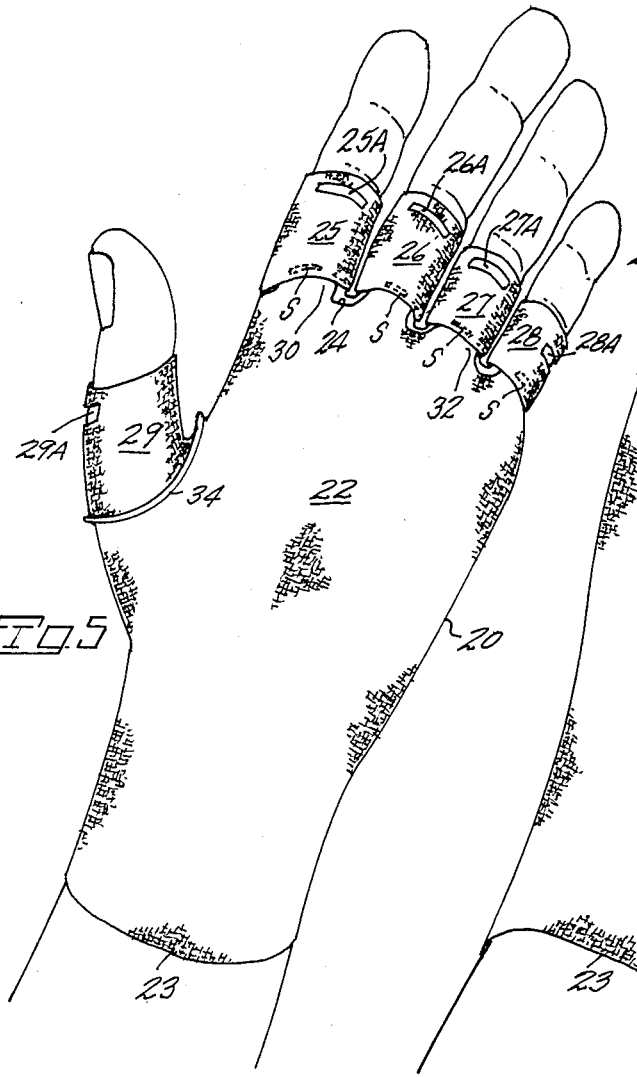
FIG. 5 is a view similar to FIG. 1 but showing a modified form of insert.
Figure 6:
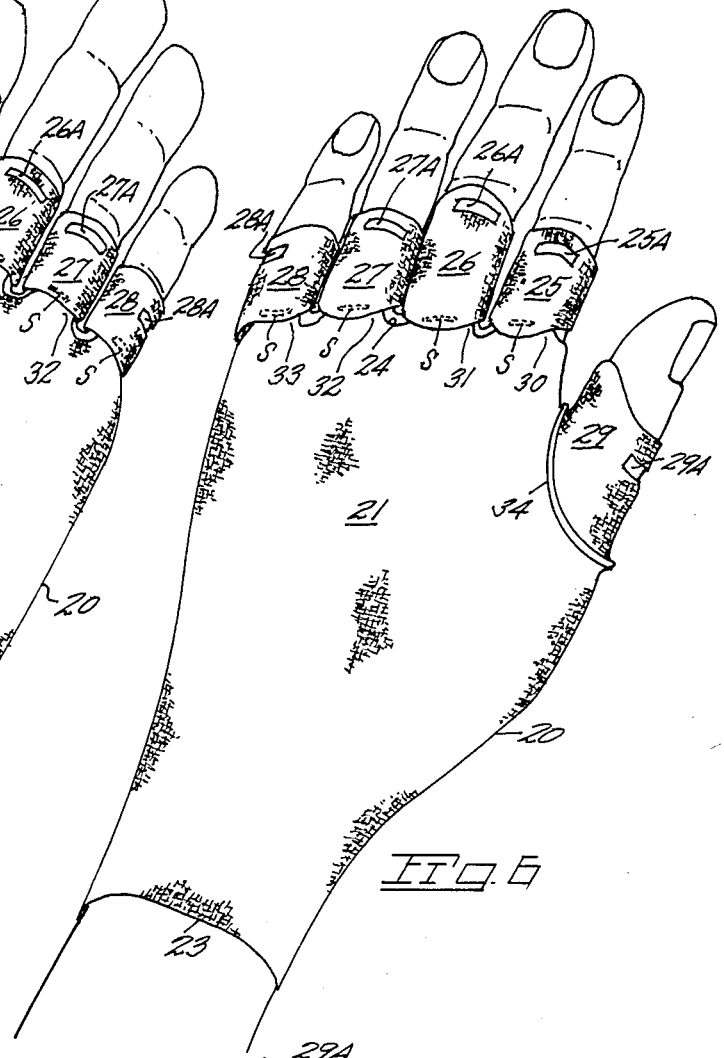
FIG. 6 is a view similar to FIG. 5 but showing the back side of the hand with the modified form of insert of FIG. 5 thereon with an insert for the right hand being a mirror image.
Figure 7:
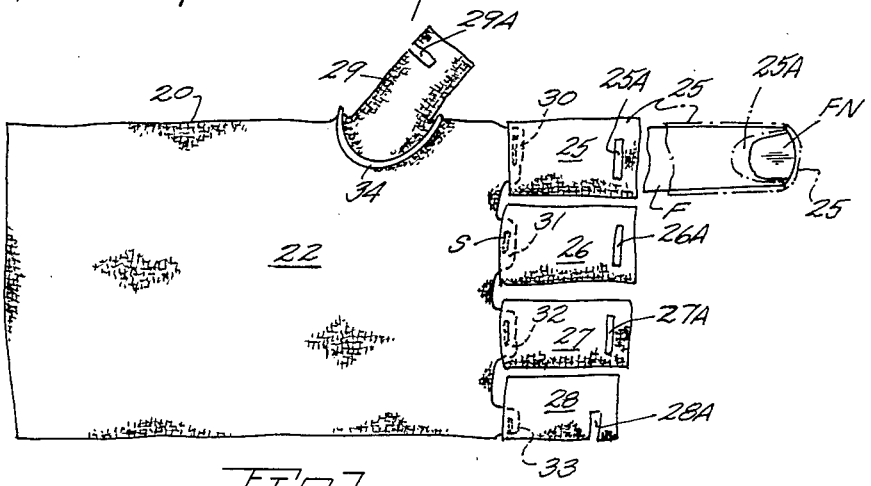
FIG. 7 is a plan view of the modified insert removed from the hand and flattened.

With regard to the modified form of insert in FIGS. 5, 6 and 7, the main body 20 is of tubular construction having a back side 21 and a palm side 22. An end 23 of the main body is located about the wearer's wrist while an opposite end at 24 receives tubular finger members 25, 26, 27 and 28. A tubular finger member 29 receives the thumb. Main body end 24 has protrusions as at 30, 31, 32 and 33 to facilitate attachment of the finger members as by stitching at S. It may, in some instances, be feasible to form the finger members from the same expanse of material as the main body 20 is formed from. Thumb receiving finger member 29 is attached to the main body by a continuous seam at 34 extending about an opening in the main body.

To prevent displacement of the finger members in a proximal direction during rubber glove application over the insert, it has been found desirable to provide openings as at 25A–29A in the finger members to enable temporary, hooked engagement of each member with the distal end of a finger. Finger members 25, 26 and 27 have pairs of openings 25A, 26A and 27A. The edge of each opening 25A–29A may be temporarily hooked about the protruding end of finger or its fingernail. Subsequent to glove application, the stretched finger members in the glove may be readily dislodged from the fingertips by the remaining hand. That area of each finger member adjacent the openings 25A–29A may be reinforced by stitching to assure retentive engagement with the fingertip. In FIG. 7, an index finger at F is shown with tubular member 25 hooked over the fingernail FN prior to glove insertion.

One suitable fabric for use in the modified glove insert is that sold under the registered trademark X Span and presently marketed as a tubular bandage for wear about injured arm or leg joints. Such material is of an absorbent nature and constructed so as to stretch along multiple perpendicular axes. In the trade, such material is widely used and known as tubular dressing retainers.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

I claim:

1. An absorbent glove liner comprising, a fabric main body of an absorbent elastic nature for stretched engagement with the hand, and tubular members on said main body and also of an elastic nature and each receiving a finger, said tubular members adapted to cover only a portion of each finger, some of said tubular members defining openings to temporarily engage the end of the finger during donning of a glove to prevent gathering of the tubular member during said donning.

2. The liner claimed in claim 1 wherein said body is of tubular construction, said body defining an opening in communication with a tubular member receiving the thumb.

3. The liner claimed in claim 1 wherein said main body is open at both ends, said tubular members attached to said main body at one of said ends.

4. An absorbent glove for wear between a rubber glove and the hand, said absorbent glove comprising, a main body of absorbent fabric and elastic along two axes for a snug fit about the hand, and tubular members of like fabric and adapted for stretched engagement about the distal end of each finger prior to and during donning of the ruber glove, said tubular members having a normal length so as to leave a portion of the finger in contact with the interior of the rubber glove, some of said tubular members each defining an opening adjacent one end of the tubular member to temporarily receive and engage the end of the finger prior to and during donning of a rubber glove to prevent gathering of the tubular member on the finger.

* * * * *